US007246413B2

(12) United States Patent
Portelli

(10) Patent No.: US 7,246,413 B2
(45) Date of Patent: Jul. 24, 2007

(54) MAGNETIC SAFETY KNOB FOR A CABINET DOOR

(76) Inventor: Charles Portelli, 2b Korford Street, Hampton, Vic (AU) 3188

( * ) Notice: Subject to any disclaimer, the term of this patent is extended or adjusted under 35 U.S.C. 154(b) by 88 days.

(21) Appl. No.: 11/038,581

(22) Filed: Jan. 21, 2005

(65) Prior Publication Data

US 2005/0283950 A1 Dec. 29, 2005

Related U.S. Application Data

(60) Provisional application No. 60/575,098, filed on May 28, 2004.

(51) Int. Cl.
*E05B 1/00* (2006.01)

(52) U.S. Cl. ..... 16/414; 16/441

(58) Field of Classification Search ..... 16/441, 16/412–414, 417, DIG. 24, DIG. 40; 292/251.5, 292/252, 348, 350; 24/303; 403/225, 355; 411/177

See application file for complete search history.

(56) References Cited

U.S. PATENT DOCUMENTS

| | | | | | |
|---|---|---|---|---|---|
| 1,754,767 | A | * | 4/1930 | Potter | 403/4 |
| 1,798,409 | A | * | 3/1931 | Ferris | 16/414 |
| 2,209,644 | A | * | 7/1940 | Colby | 16/433 |
| 2,440,170 | A | | 4/1948 | Duefrene | 16/121 |
| 2,697,642 | A | * | 12/1954 | Rudy | 403/410 |
| 2,731,663 | A | * | 1/1956 | Thompson | 16/422 |
| 2,947,507 | A | * | 8/1960 | Schlage et al. | 248/206.5 |
| 3,009,225 | A | * | 11/1961 | Budreck | 24/303 |
| 3,100,363 | A | * | 8/1963 | Staver | 401/6 |
| 3,288,511 | A | * | 11/1966 | Tavano | 292/251.5 |
| 3,302,566 | A | | 2/1967 | Blanchet | 101/405 |
| 3,438,414 | A | * | 4/1969 | Isadore | 30/519 |
| 4,082,351 | A | | 4/1978 | Chrones | 297/347 |
| 4,158,216 | A | * | 6/1979 | Bigelow | 200/600 |
| 4,253,690 | A | | 3/1981 | Hollander | 292/354 |
| 4,630,331 | A | * | 12/1986 | Collister | 16/430 |
| 4,919,464 | A | | 4/1990 | Richards | 292/251.5 |
| 4,969,273 | A | | 11/1990 | Richards | 33/613 |
| 5,076,623 | A | | 12/1991 | Richards | 292/251.5 |
| 5,159,739 | A | | 11/1992 | Adinolfi | 16/144 |
| 5,188,405 | A | | 2/1993 | Maccafferri | 292/204 |
| 5,954,064 | A | * | 9/1999 | Motherhead | 132/262 |

(Continued)

FOREIGN PATENT DOCUMENTS

AT 405567 B * 7/1999

(Continued)

*Primary Examiner*—Chuck Y. Mah
(74) *Attorney, Agent, or Firm*—Robert Platt Bell

(57) ABSTRACT

A magnetic knob is provided for use with a series of plates attached to threaded mounts which may be substituted for kitchen or bathroom cabinet door or drawer knobs. The user simply unscrews existing kitchen and/or bathroom cabinet knobs and replaces them with flat metal plates attached to threaded shafts. The metal plates are a direct replacement for the existing knobs and may not require any drilling or screwing or even use of tools. Once installed, the metal plates provide no means of gripping. Thus, the cabinet cannot be opened by a child or other unauthorized user (e.g., mentally handicapped individual). A knob provided with a strong magnet is provided so that an authorized user may attach the knob to one of the metal plates and thus open the cabinet.

4 Claims, 7 Drawing Sheets

U.S. PATENT DOCUMENTS 6,431,616 B1 8/2002 Julian ..... 292/171
6,477,749 B1 * 11/2002 Reiter ..... 24/303

FOREIGN PATENT DOCUMENTS

EP 1407702 A1 * 4/2004
JP 10151074 A * 6/1998
JP 410151074 A 6/1998
KR 2201091783 A * 10/2001
RU 2017011 C1 * 7/1994

* cited by examiner

MAGNETIC SAFETY KNOB FOR A CABINET DOOR

CROSS-REFERENCE TO RELATED APPLICATIONS

The present application claims priority from Provisional U.S. Patent Application No. 60/575,098 filed on May 28, 2004, and incorporated herein by reference in its entirety.

FIELD OF THE INVENTION

The present invention relates to child safety devices to prevent children from accessing kitchen or bathroom cabinets. In particular, the present invention is directed toward a removable magnetized knob and plate that be substituted for a standard cabinet knob to prevent small children and others from getting into a cabinet

BACKGROUND OF THE INVENTION

A number of child-safety devices are known in the art to protect children and others (e.g., mentally handicapped) from unauthorized access to cabinets, cupboards, and the like.

One such product is marketed under the name SAFETY1ST TOT LOK FOR CABINETS AND DOORS and is illustrated on www.drugstore.com and www.safety1st.com websites. The TOT LOK uses magnetically activated latch that is attached to the inside of a door. Applying a magnetic "key" to the other side of the door releases the latch.

A number of Patents are related to the TOT LOK device. Richards, U.S. Pat. No. 4,919,464, issued Apr. 23, 1990, and incorporated herein by reference, discloses a magnetically operated latch. This latch is located on the INSIDE of the cabinet and requires some drilling to install. A magnetic "knob" is placed on the outside of the cabinet to unlatch the latch, but it does not appear that this knob is used to actually pull open the cabinet door. Richards explicitly states that a conventional handle (not shown) is used to open the door (Col. 2, lines 65-68) although the magnetic knob may remain attached to the door. This type of device would probably tend to scar the finish of the cabinet by sliding the knob against the outside. In addition, it requires some extensive machining to the cabinet to install the rod and latch hardware.

Note that the rod installation is particularly troublesome, as it requires the user to drill a substantially sized hole, partially through the cabinet door. Careless drilling could result in the user putting a hole through the cabinet face, ruining the cabinet. From casual inspection of the TOT LOK latches at the local LOWES™ home improvement center, it appears that the rod portion may have been deleted from the final design. Nevertheless, the TOT LOK requires that holes be drilled into the inside of the cabinet door to install. Moreover, the TOT LOK apparatus is not cheap.

Richards, U.S. Pat. No. 4,969,273, issued Nov. 13, 1990, and incorporated herein by reference, discloses a method of marking a cabinet or door for drilling using a sticker template. This Patent is not really relevant to the present invention, but illustrates the amount of careful machining necessary in order to install the TOT LOK magnetic catch on a door. The template is really needed, as accurate drilling may be necessary in order to insure the magnetic catch is properly installed.

Richards, U.S. Pat. No. 5,076,623, issued Dec. 31, 1991, and incorporated herein by reference, is a Continuation-In-Part of the Richards '464 Patent and appears to disclose minor variations on the original TOT LOK design.

Maccaferri, U.S. Pat. No. 5,188,405, issued Feb. 23, 1993, and incorporated herein by reference appears to disclose the identical TOT LOK invention as Richards '464 filed nearly a year earlier. However, the two applications do not claim priority from one another and although the drawings are identical in every aspect, it is clear they were drawn by different draftsmen. Maccaferri appears to be claiming only an improvement in the Richards design, namely a locking means to hold the latch open when it is not desired to lock the cabinet.

The TOT LOK Patents teach a device which uses a magnet to release a CATCH, not to open the door. Moreover, Richards explicitly states that his device cannot open the door, but the user must rely upon the existing handle. The TOT LOK device is not easy to install, as it requires drilling into the cabinet as illustrated by Richards drilling template Patent. In addition, the catch release of Maccaferri defeats the whole point of TOT LOK. A user must manually test each cabinet to insure that the latch is not defeated. Yet, the catch release of Maccaferri is necessary, as it would be cumbersome for a user to have to release a catch every time they wanted to use a cabinet.

While TOT LOK represents an effort in improving the safety of cabinetry, its cost, complexity, difficult installation, modification of cabinetry, and lack of easy use, leave it lacking. For example, a parent renting a home would be hesitant to use TOT LOK as it would modify or alter the cabinetry, and the landlord might not approve of such alterations. In addition, the installation requires a number of hand tools as well as a drill, and thus takes considerable time and skill to install. What is needed is a simple device which can be installed by any parent or consumer, even those without hand tools skills.

Other Patents are known in the art, which show various types of child safety devices. JULIAN, U.S. Pat. No. 6,431,616, issued Aug. 13, 2002, and incorporated herein by reference, discloses a child safety latch assembly. This complex apparatus requires that the user hold the drawer face while pulling the knob in order to release the drawer. It is not clear why merely pulling the knob will not release the drawer. The device is complex and requires a fairly complicated installation procedure. Moreover, this apparatus does not appear to be safety oriented, but rather provides only a positive latching mechanism to prevent a drawer from opening accidentally. While Julian mentions that child safety is one motivation behind his latch, it is unclear to applicant how this device provides any child safety. To hold one hand on the drawer face while pulling the knob may be intuitive to a child. Thus, there is no positive mechanism that prevents a child from opening such a drawer or cupboard.

CHRONES, U.S. Pat. No. 4,082,351, issued Apr. 4, 1978, and incorporated herein by reference, discloses a safety cover for a doorknob. This safety cover is typical of the various sliding covers sold at safety stores and on-line to parents. While useful for doorknobs, they are not applicable to cabinets and the like. Since the device rotates over the doorknob, it may prevent a child from opening a door. When the child tries to turn the cover, it rotates freely, and the doorknob does not turn. However, if this device were applied to a cupboard or drawer knob, it would provide no safety. If the child pulled on the cover, the cupboard or drawer would open.

HOLLANDER, U.S. Pat. No. 4,253,690, issued Mar. 3, 1981, and incorporated herein by reference, discloses a safety knob using a ratchet mechanism. Again, this knob does not appear to be readily adaptable to kitchen cabinets with friction or magnetic catches, as it is designed for rotating door knobs. The ratchet mechanism prevents a child from rotating the doorknob in one direction. The device does not prevent anyone from pulling on the knob, however.

The idea of providing removable knobs for child safety appears to be known in the art. DUEFRENE, U.S. Pat. No. 2,440,170, issued Apr. 20, 1948, and incorporated herein by reference, discloses a removable knob, which he teaches may be used for furniture and the like. The knob snaps off by using an interference fit between two pliable materials. DUEFRENE explicitly discloses that his removable knob may be used as a child-safety device (Col. 1, lines 50-55), but does not disclose any magnetic feature.

One problem with DUEFRENE is that his knob snaps onto a screw or base. Thus, even when the knob is removed, the base or screw is still present and can be used to pull open a cabinet. See, for example, FIGS. 4, 5, 6, and 10 of DUEFRENE. In order to be really effective as a child safety knob, a removable knob should leave no base or screw that a child could grasp and open the cabinet with. In addition, the mechanical snap fastener of DUEFRENE would appear to wear over time, and thus the apparatus could lose its effectiveness (grip) after repeated use.

The idea of magnetically removable knobs or handles is known in other arts, but it does not appear that any of these types of knobs or handles have been applied to the child safety problem. The TOK LOK described above uses magnets, but only to release a catch.

ENDOU, Published Japanese Patent Application Ser. No. JP 4-10151074A, published Jun. 9, 1998, and incorporated herein by reference, discloses a magnetic knob, which may be applied to pot lids. By removing the knob, the lids may be nested for better storage. Note that his "magnet board" 3 (See FIG. 2) is attached to the pot lid by a flange. It appears that this knob is designed to be built-in to the pot lid at the factory, and is not an add-on device for installation by a consumer. ENDOU does not teach or suggest applying his magnetic knob to other applications.

ADINOLFI, U.S. Pat. No. 5,159,739, issued Nov. 3, 1992, and incorporated herein by reference, discloses a sanitary equipment handler using magnetically held, detachable handle. ADINOLFI discloses that a surgeon or the like can hold the handle to open drawers or move equipment without having to touch the equipment with his hands.

ADINOLFI uses magnetic plates mounted on the devices to be moved (drawers, lights, etc.) and provides a knob-like sterilize-able handle (FIG. 1) made of a ferrous material to attach to such magnetic plates. The ADINOLFI design requires a number of expensive magnets, one for each cabinet door or drawer. ADINOLFI probably uses the magnets on the drawers, as constantly autoclaving magnets on handles (to sterilize them) would probably demagnetize them. For an application like surgical devices, such an expense is probably acceptable. But for a consumer application, providing a number of expensive and powerful magnets would not be cost-effective.

In addition, the device of ADINOLFI requires that these magnets be installed to each device to be manipulated by the sterilized handle. The devices to be manipulated must have the magnets built-in to them or have them attached using hardware attached through holes 8. Thus, drilling or machining of the device to be manipulated is required, which necessitates the alteration of the device to be manipulated, as well as the use of power tools to install the device.

There are other disadvantages of ADINOLFI as well. The presence of so many magnets could create problems, as watches, jewelry, forks, knives, and other cutlery, could attach themselves to the magnets of ADINOLFI if it could be adapted for kitchen use (Note that ADINOLFI makes no such teaching or suggestion). As ADINOLFI is directed toward surgical applications, this may not be a problem in that environment, as many if not most surgical tools are made from stainless steels, which are non-magnetic. However, in households, magnetic materials abound. Watches in particular can be damaged by large magnets. The large magnetic plates are also unsightly and would be difficult to mount, as drilling and screwing would be required.

BLANCHET, U.S. Pat. No. 3,302,566, issued Feb. 7, 1967, and incorporated herein by reference, discloses a magnetic handle for a series of rubber stamps. BLANCHET uses two magnets having their poles in opposite relationship (N-S) so as to attract to one another. One magnet is mounted to the stamp handle, and the other to the rubber stamp body. BLANCHET probably used this two-magnet technique as it allowed him to use less powerful magnets. Note that the size of the handle shaft precludes the use of a magnet of any appreciable size. The use of two magnets increases the overall cost of the design. BLANCHET does not teach or suggest the use of his invention outside of the rubber stamp art.

Thus, a requirement remains in the art for an inexpensive, easy to install, and easy to use system that can provide "child-proofing" of cabinets without having to drill holes in the cabinets. Such a system should have an easy visual way of determining whether the cabinets are secured without having to manually latch each cabinet. Moreover, such a system should be easy enough for the average homeowner to install without the use of screws, drills, or even tools.

SUMMARY OF THE INVENTION

A magnetic knob is provided for use with a series of ferrous metal (e.g., steel) plates attached to threaded mounts which may be substituted for kitchen or bathroom cabinet or door knobs or handles. To reduce the risk of children or other unauthorized persons from accessing medicine cabinets or other storage areas, a user simply unscrews existing kitchen and/or bathroom cabinet knobs and replaces them with the flat metal plates attached to threaded shafts. The metal plates are a direct replacement for the existing knobs and may not require any drilling or screwing or even use of tools. A simple wingnut can be used to secure the plates to the cabinets, drawers, or other enclosure.

Once installed, the metal plates provide no means of gripping, such that the cabinet cannot be opened by a young child or other unauthorized user (e.g., mentally handicapped individual or the like). A knob ("TRAVELKNOB™") provided with a strong magnet is provided so that an authorized user (e.g., parent, adult, or the like) may attach the knob to one of the metal plates and thus open the cabinet.

The TRAVELKNOB™, having a powerful magnet at its base, may be easily stored by attaching it to the refrigerator or other appliance, at a level out of reach of children. The powerful ring magnet has an effective pull strength of 11 Kilograms, enough to overcome the resistance of most magnetic, spring-loaded, or friction cabinet catches. The metal plates, being flat, provide an attractive appearance, but no purchase or grip to open a cabinet, drawer, or the like.

Unlike other Prior Art solutions, which may require careful machining or modification of cabinet doors, the apparatus of the present invention can be readily installed in the place of an existing cabinet knob using simple hand tools, or even just hands. Thus, a homeowner or other consumer can install the TRAVELKNOB™ without having to modify or alter the cabinetry. When a child grows up or the product is deemed no longer necessary, the original knobs can be reinstalled without any damage or alteration to the cabinetry. Thus, the apparatus of the present invention can be used both by homeowners and renters, and cabinets can be restored to their original appearance without any damage or alteration.

The APPENDIX attached to the Provisional U.S. patent application Ser. No. 60/575,098, filed May 28, 2004, includes sales materials for the present invention, which further describes the present invention. This APPENDIX as well as the entire Provisional Patent Application, are explicitly incorporated herein by reference.

DETAILED DESCRIPTION OF THE INVENTION

Figure 1:
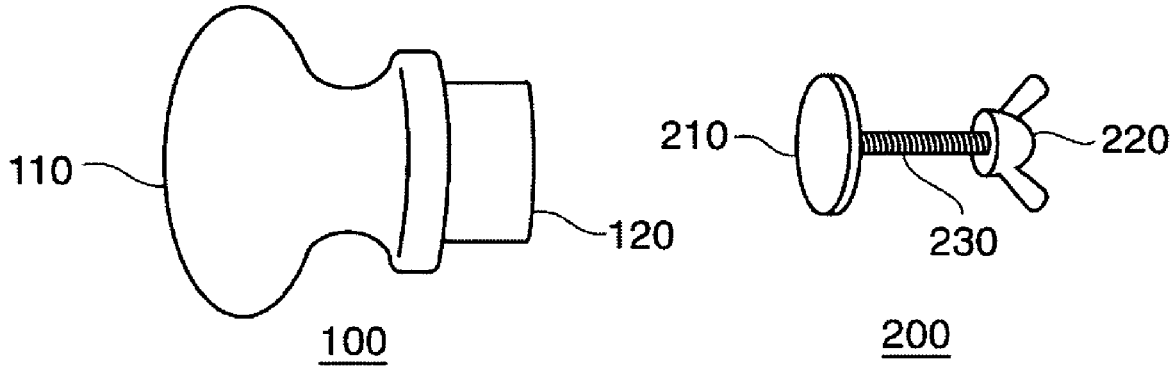
FIG. 1 is a side view of the TRAVELKNOB™ and a stud of the present invention.

FIG. 1 is a side view of the TRAVELKNOB™ and a stud of the present invention. The apparatus includes TRAVELKNOB™ 100 and stud 200. TRAVELKNOB™ 100 includes handle portion 110 and magnet portion 120. Handle portion 110 may be made in any user-friendly shape including the traditional knob design illustrated in FIG. 1. Other knob designs may be used without departing from the spirit and scope of the present invention. Designer knobs and the like may be used to match existing kitchen decor and/or match other knobs, which are on upper cabinets out of the reach of children.

In one alternative embodiment, handle portion 110 may be deleted or removed from the design, allowing a consumer to substitute their own knob in place of handle portion 110 onto magnet portion 120 so as to match other knobs in the kitchen if desired. Note also that the apparatus of the present invention may be adapted for handles and the like by providing two magnet portions 120, for example, to replace drawer or cabinet pulls which use two holes in the cabinet to mount a handle or pull or the like, or two studs 210 may be used, one in each hole, and a single knob used to open the cabinet.

Stud 200 may include striking plate 210, threaded shaft 230, and wingnut 220. Striking plate 210 comes into contact with magnet portion 120 of TRAVELKNOB™ 100 as will be illustrated below. Thus, striking plate 210 should be made of a Ferro-magnetic material such as steel or the like. Threaded shaft 230 may be sufficiently long enough so as to be mounted through cabinet doors and drawer faces of standard thicknesses. The diameter of threaded shaft 230 may be of the same or similar size as that used by standard threaded drawer and cabinet knob fastening screws and thus no additional driller is required to install the stud 200. The existing hole from an existing drawer or cabinet pull may be used.

In the preferred embodiment, two lengths of threaded shaft 230 may be offered; a 40 mm (1.5 inches) length for cabinet doors and the like, and a 50 mm (2 inch) length for drawer faces and other thicker cabinet faces. Wingnut 220 is provided to secure striking plate 210 to a cabinet door or drawer front without the use of tools. Alternate threaded fasteners may be used in place of wingnut 220, including but not limited to traditional hex nuts and the like.

Note that while illustrated here in the preferred embodiment as including a threaded shaft 230 and wingnut 220, other types of attachment means may be used without departing from the spirit and scope of the present invention. For example, striking plate 210 may be provided with an internally threaded portion and a screw, bolt or the like may be screwed through a cabinet door or drawer to attach striking plate 210 to the cabinet door or drawer. Alternately, adhesive may be used to attach striking plate to the surface of a cabinet door or drawer.

Figure 2:
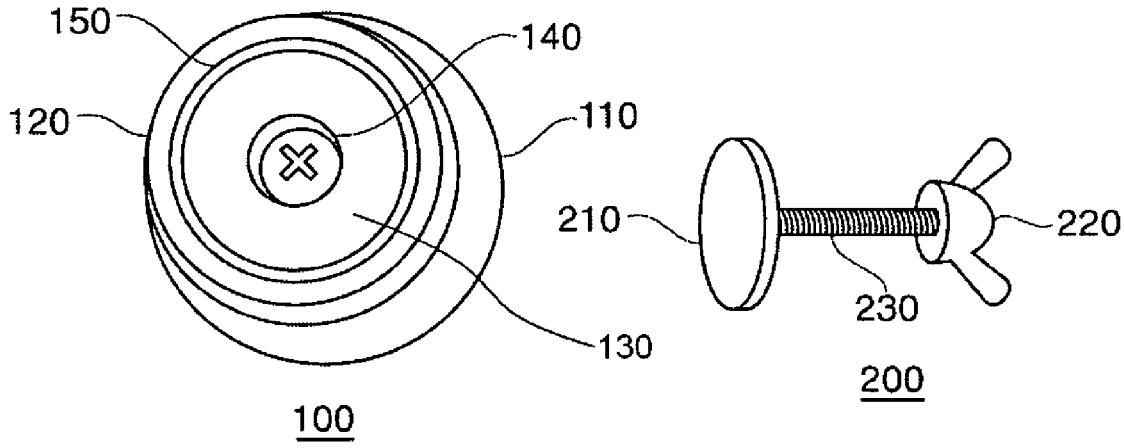
FIG. 2 is a bottom view of the TRAVELKNOB™ and a side view of the stud of the present invention.

FIG. 2 is a bottom view of the TRAVELKNOB™ and a side view of the stud of the present invention. In this view, the structure of TRAVELKNOB™ is more clearly delineated. As seen from this view, the magnet portion 120 of TRAVELKNOB™ includes ring magnet 130, attachment screw 140, and trim ring 150. Ring magnet 130 may comprise a magnet in a ring shape, with a pulling strength of approximately 11 Kilograms to insure that there is sufficient strength to overcome conventional kitchen or bathroom cabinet door or drawer latches. Trim ring 150 may comprise a pot-shaped housing which houses the magnet.

Trim ring 150 shields and protects ring magnet 130 and also increases the magnetic pull between north and south, which gives it increased strength. Ring magnet 130 may be glued to the trim ring pot 150 and trim ring pot 150 may then be screwed and glued to knob 110. The outer circumference and trim ring pot 150 may be coated with an epoxy resin to withstand the impact of the magnet meeting with the stud. Ring magnet 130 may comprise a Rare Earth Permanent Magnet (Neodymium Iron Baron grade N33).

Screw 140 attaches trim ring pot 150 to knob portion 110. Other types of attachment other than screw 140 may be used, including rivets, adhesives, and the like. In one embodiment, screw 140 may allow knob portion 110 to be removed and a designer knob or other custom knob inserted to suit the customer's tastes. Trim ring pot 150 may be located around ring magnet 130 so that magnet portion 120 has a clean, finished look and also serves as a mounting point to epoxy or glue ring magnet 130.

In the preferred embodiment, magnet 130 may be attached to trim ring pot 150 by adhesive (hot glue or the like). However, other types of attachment may be used without departing from the spirit and scope of the present invention. For example, screw 140 may be a flat head screw and may attach through a chamfered hole in magnet 130 to trim ring pot and/or knob 110.

Note that the diameter of ring magnet 130 is about 1 inch in diameter, which is about the same diameter as striking plate 210. Trim ring 150 may be slightly larger than the diameter of striking plate 210 so that when TRAVEL- KNOB™ is attached to striking plate 210, as will be illustrated below, trim ring 150 forms a neat finished appearance on a cabinet.

Figure 3:
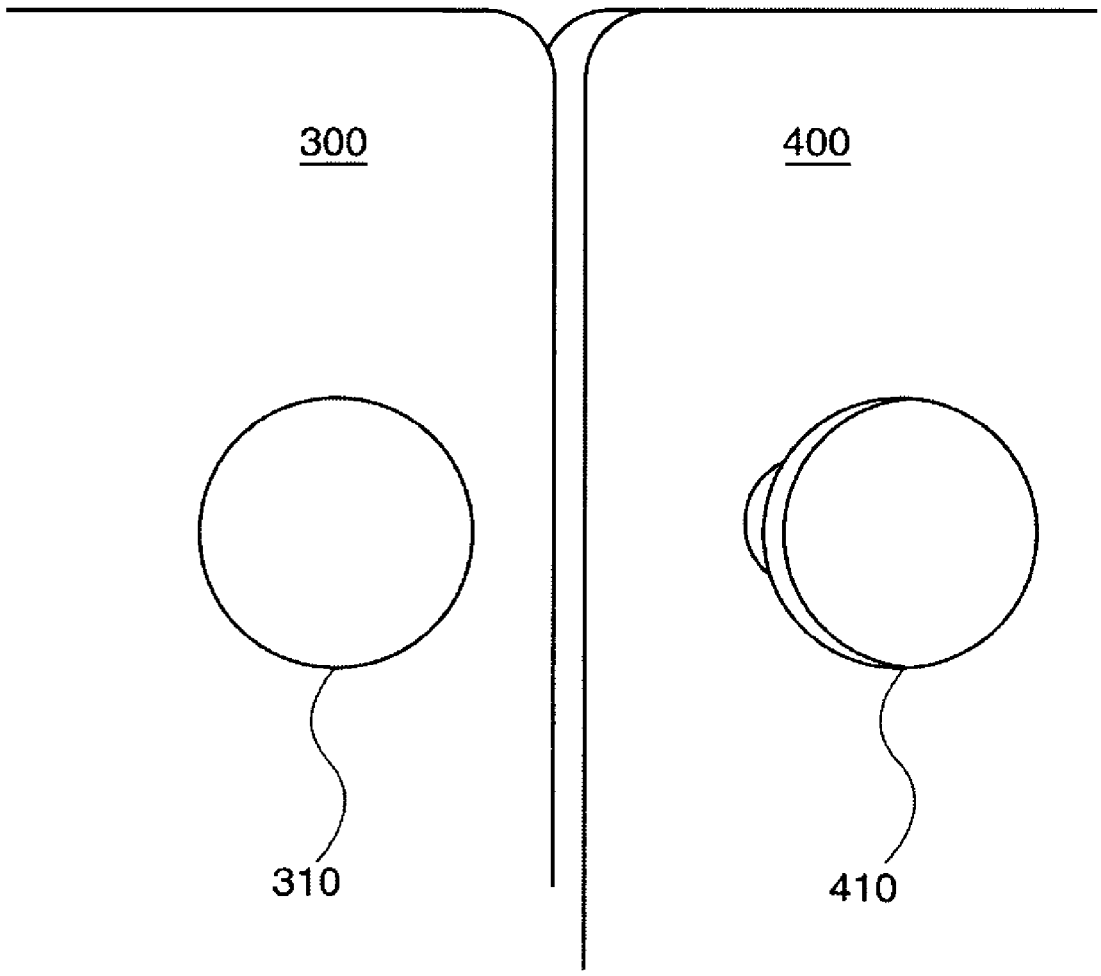
FIG. 3 is a front view of a kitchen cabinet showing the use of conventional kitchen cabinet knobs.

FIG. 3 is a front view of a kitchen cabinet showing the use of conventional kitchen cabinet knobs. In this view, the kitchen cabinet includes doors 300 and 400 having respective conventional knobs 310 and 410. Note that this view is for illustrative purposes only and should not be construed as limiting the application in any way. The present invention may also be applied to single cabinet doors, drawers, lazy Susans, bathroom cabinets, stereo and electronics cabinets, and any other application where a pull is used.

Figure 4:
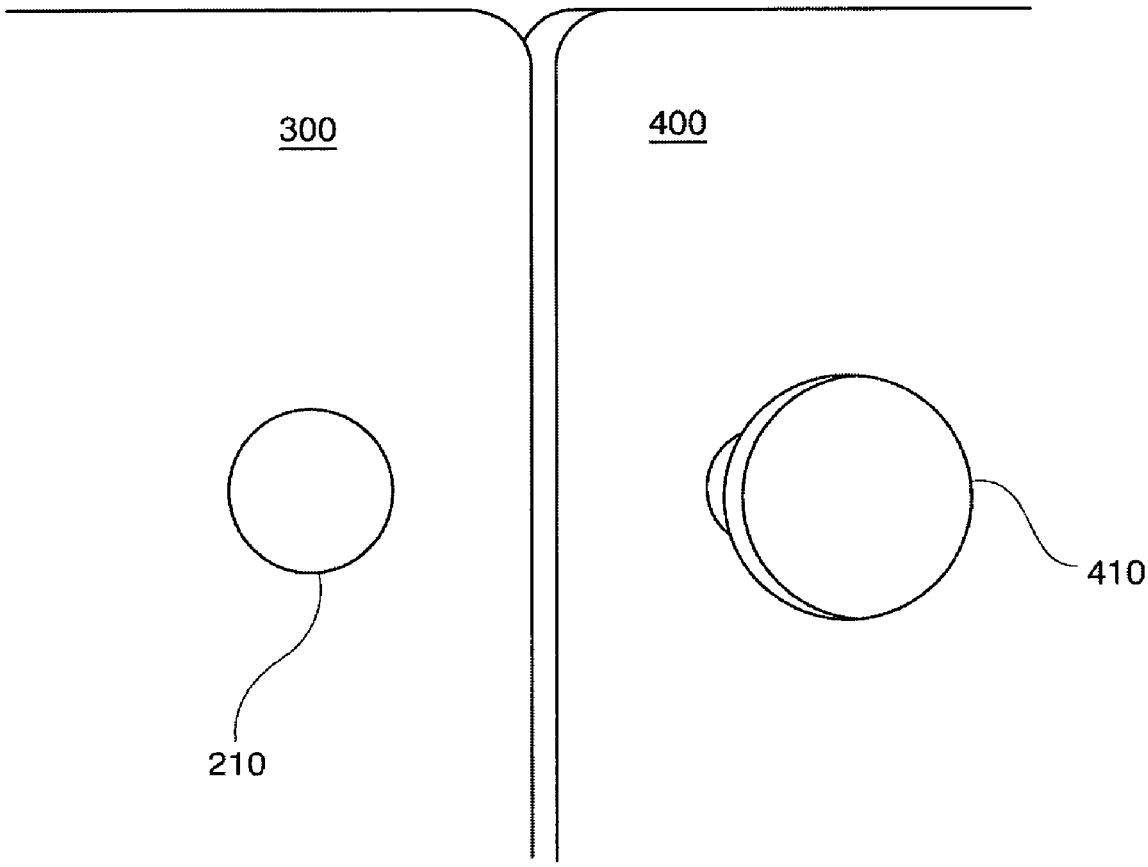
FIG. 4 is a front view of a kitchen cabinet showing the installation of the stud in place of one of the knobs.

FIG. 4 is a front view of a kitchen cabinet showing the installation of the stud 210 in place of one of the knobs 310. Installation of stud 210 is as follows. First, the existing knob may need to be removed. In some applications, this may require the use of a screwdriver to unscrew a screw fed through the back of cabinet door 300. In this instance, merely turning knob 310 anti-clockwise resulted in the knob coming off. After removing the associated screw, the threaded shaft 230 of stud 200 is fed through the existing hole in the cabinet and secured using wingnut 220.

When properly installed, striking plate 210 of the stud assembly 200 will be nearly flush with the surface of cabinet door 300 and allow no purchase for one to grasp or otherwise attempt to open door 300. Note also that when installed properly, striking plate 210 provides a neutral and attractive appearance and does not detract from the overall appearance of cabinet door 300. Striking plate 210 may be provided in a natural finish (bare metal) or may be provided with a coating (paint, plating or the like) to match cabinet or knob finishes (e.g., antique brass, brass, pewter finishes. To prevent scratching of such finished surfaces, magnet 130 may be coated with a rubberized coating or the like.

Figure 5:
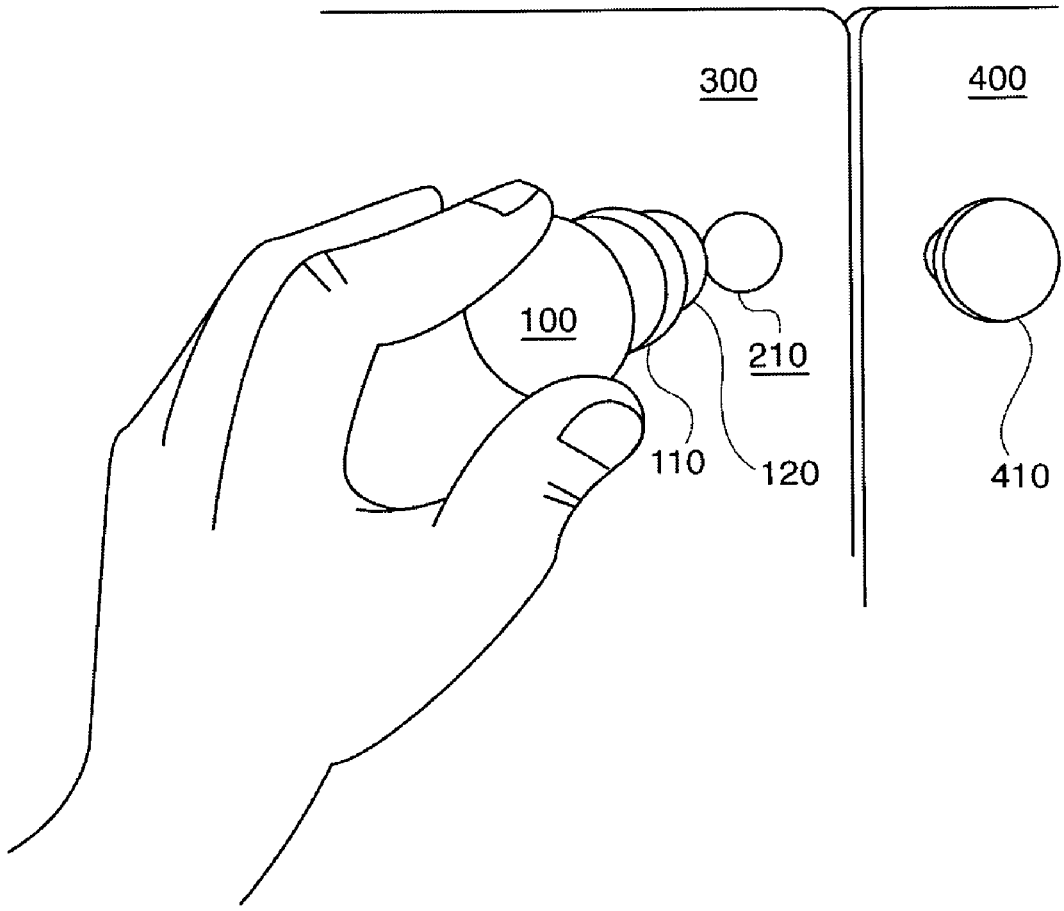
FIG. 5 is a front view of a kitchen cabinet showing how the TRAVELKNOB™ can be magnetically attached to the stud.

FIG. 5 is a front view of a kitchen cabinet showing how the TRAVELKNOB™ 100 can be magnetically attached to the stud 200. When a user wishes to open a cabinet, they need only remove the TRAVELKNOB™ 100 from its storage location such as a refrigerator door or other appliance (e.g., range hood) and attach TRAVELKNOB™ to striking plate 210 as illustrated in FIG. 5.

Figure 6:
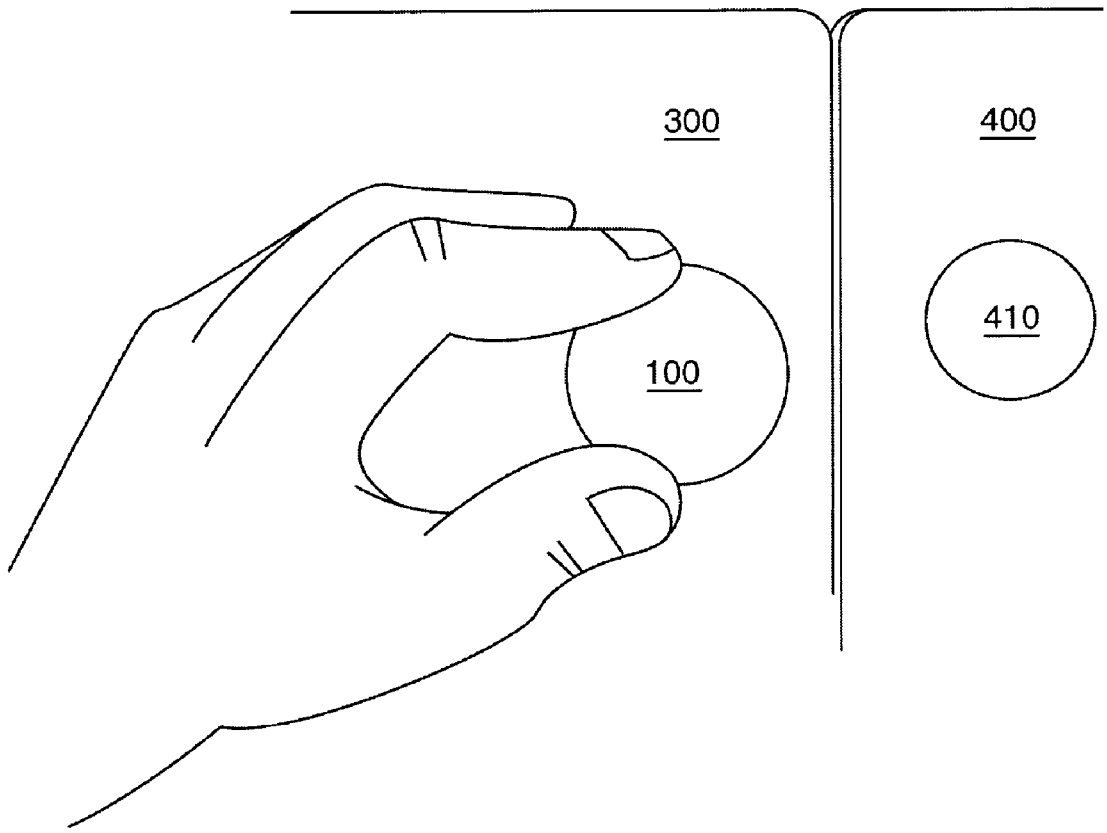
FIG. 6 is a front view of a kitchen cabinet showing the TRAVELKNOB™ attached to the stud.

The powerful ring magnet 130 will cause TRAVELKNOB™ 100 to attract itself to striking plate 210 and center itself (roughly) on striking plate 210 as illustrated in FIG. 6. FIG. 6 is a front view of a kitchen cabinet showing TRAVELKNOB™ 100 attached to the stud 200. Note that when TRAVELKNOB™ 100 is attached to stud 200, it appears as a regular kitchen knob. If left in place, TRAVELKNOB™ 100 looks just like an ordinary kitchen cabinet knob.

In the preferred embodiment, a single TRAVELKNOB™ 100 may be provided to the consumer, along with a number of stud plates 210. However, other numbers of knobs 100 may be provided such that each cabinet, for example (or a plurality of cabinets) may be provided with knobs 100 which may be left in place, for example when cooking in the kitchen or when company is coming over. Thus, the appearance of the cabinets and kitchen does not appear to be altered or "child proofed" to guests and others. When the consumer wishes to child-proof the kitchen, the knobs 100 can then be quickly removed and placed in storage or attached to a kitchen appliance (e.g., range hood, refrigerator, or the like) out of reach of children.

In addition, as noted above, other types of attachment means may be used to secure the plates to the cabinet doors, drawers, or the like. For example striker plate 210 may be secured with adhesive to the face of a cabinet, drawer, or the like, or may be provide with a threaded wood screw so that striker plate 210 may be screwed into the face of a cabinet door or drawer. In such an embodiment, striker plate 210 may be provided with notches or be shaped or indented such that a tool or the like can be used to screw in striker plate 210 into the face of the cabinet door, drawer or the like.

Note also that striker plate 210 may be provided in shapes other than the round shape shown in the drawings. In addition, striker plate 210 may be made larger so as to cover a larger area and thus prevent scratching of the cabinet surface by the use of the TRAVELKNOB™ 100 when attaching to striker plate 210. Alternately, a plastic backing plate (transparent or colored) or other type of backing plate may be used so that use of the TRAVELKNOB™ does not damage the surrounding surface of the cabinet door or drawer face through careless or hasty use.

Figure 7:
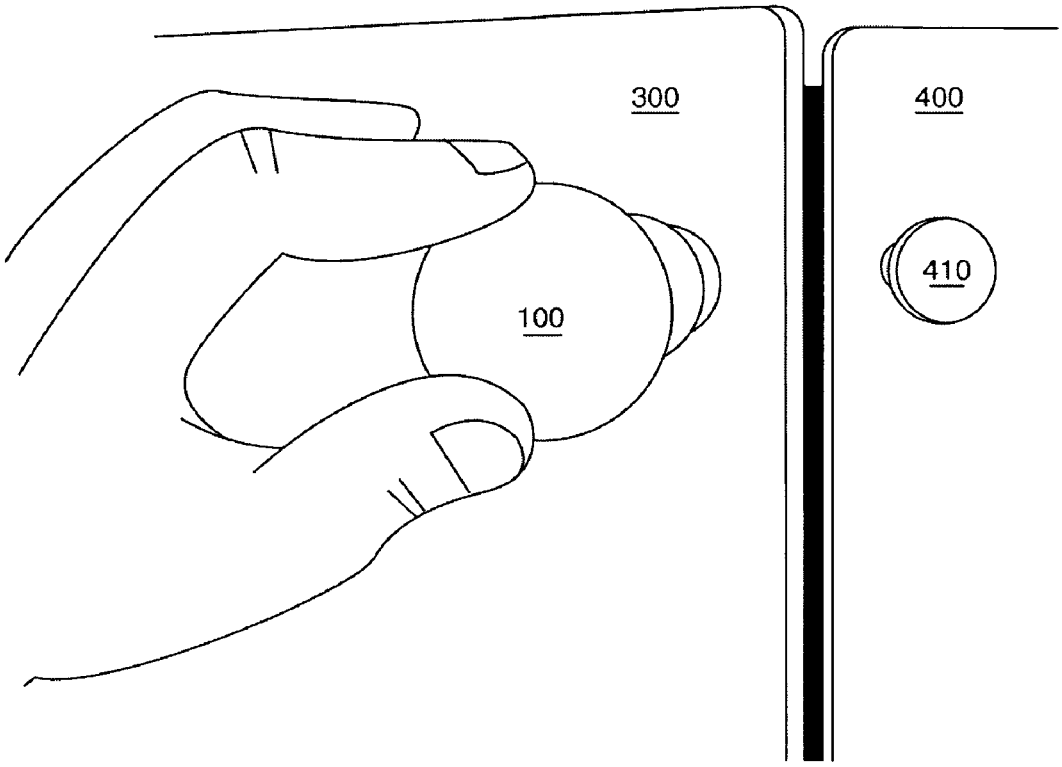
FIG. 7 is a front view of a kitchen cabinet showing the TRAVELKNOB™ being used to open the kitchen cabinet.

FIG. 7 is a front view of a kitchen cabinet showing the TRAVELKNOB™ 100 being used to open the kitchen cabinet door 300. As ring magnet 130 has a substantial pulling strength of approximately 11 Kilograms, TRAVELKNOB™ 100 can easily open a cabinet held closed by spring latches, friction latches, magnetic latches or other devices. Without TRAVELKNOB™ 100 in place, however, it may be difficult for a child to open the same cabinets as the child will not have sufficient grip on cabinet door 300.

Note that for the purposes of illustration and comparison, TRAVELKNOB™ is shown installed only on cabinet door 300. In actual use, both cabinet doors 300 and 400 may have TRAVELKNOB™ studs 200 installed to childproof the cabinet. Also note that although described in connection with the drawings as being used with a cabinet door, the present invention may also be used on drawer faces, lazy Susans, slide out spice racks, and other kitchen, bathroom, and other cabinetry applications or other enclosures (boxes, garage cabinets, curio boxes, jewelry boxes, fishing tackle boxes, gun cabinets, or the like) without departing from the spirit and scope of the present invention.

Note also that unlike Prior Art devices, the present invention does not require drilling into the cabinet where a hole has already been drilled for an existing knob. When the children are grown, TRAVELKNOB™ studs 200 may be removed and the original knobs reinstalled without any permanent damage or alteration to the cabinet. This is an important feature for many homeowners and especially important for renters.

In addition, when leaving the kitchen, a parent need only check that the TRAVELKNOB™ 100 is located safely out of the way—e.g., magnetically attached to the refrigerator or hood vent, such that it cannot be reached by children. All cabinets are thus "safe" and largely "child proof". In contrast, other inventions, such as the TOT LOK require that each cabinet be checked to insure that the latch release has not been previously set.

As sold, the unit may be packaged with a single TRAVELKNOB™ 100 and 10 studs, which may be sufficient to "child proof" an average kitchen. Since the studs are relatively inexpensive to make relative to the TRAVELKNOB™ 100 with its ring magnet 130, the entire package may be sold at a reasonable price that is attractive to young parents and the like.

While the preferred embodiment and various alternative embodiments of the invention have been disclosed and described in detail herein, it may be apparent to those skilled in the art that various changes in form and detail may be made therein without departing from the spirit and scope thereof.

I claim:

1. A method of securing a cabinet door comprising the steps of:

removing an existing knob or handle attached to cabinet door at at least one attachment point;

installing a flat planar metal plate to the cabinet door using the at least one attachment point, the flat planar metal plate being substantially flush with the cabinet door so as to provide no grip to open the enclosure; and providing a removable handle including a magnet to attach to the metal plate to open the cabinet door by authorized persons, the removable handle being removable when the cabinet door is to be secured.

2. The method of claim 1, wherein the cabinet door is at least one of a kitchen cabinet door, cupboard door, or medicine cabinet door.

3. The method of claim 1, wherein the at least one attachment point comprises a hole drilled through the face of the cabinet door.

4. The method of claim 3, wherein the step of installing the metal plate comprises the steps of passing a threaded member attached to the metal plate through the hole drilled through the face of the cabinet door and securing the threaded member with a nut on a reverse side of the face of the cabinet door.

* * * * *